United States Patent [19]

Knoepfler et al.

[11] 4,012,507

[45] Mar. 15, 1977

[54] VAPOR PHASE PROCESS TO IMPART SMOLDER RESISTANCE TO COTTON BATTING AND OTHER CELLULOSIC MATERIALS

[75] Inventors: Nestor B. Knoepfler; John P. Madacsi, both of New Orleans; Julius P. Neumeyer, Metairie, all of La.

[73] Assignee: The United States of America as represented by the Secretary of Agriculture, Washington, D.C.

[22] Filed: Mar. 5, 1975

[21] Appl. No.: 555,487

[52] U.S. Cl. ..... 427/212; 427/248 C; 428/389; 428/396; 428/921

[51] Int. Cl.[2] ..... C09K 3/28; C23C 13/04

[58] Field of Search ..... 427/248, 212; 5/354, 5/355; 297/DIG. 5; 428/389, 396, 921

[56] References Cited

UNITED STATES PATENTS

| | | | |
|---|---|---|---|
| 2,461,302 | 2/1949 | Truhlar et al. | 427/248 |
| 3,856,558 | 12/1974 | Robbart | 427/248 |

FOREIGN PATENTS OR APPLICATIONS

| | | | |
|---|---|---|---|
| 647,383 | 8/1962 | Canada | 297/DIG. 5 |

OTHER PUBLICATIONS

Bond, Def. Pub. of Ser. No. 379,874, filed 7–16–73, 920 O.G. 9, Feb. 5, 1974, No. T919,004.

*Primary Examiner*—Harry J. Gwinnell
*Attorney, Agent, or Firm*—M. Howard Silverstein; Salvador J. Cangemi; David G. McConnell

[57] ABSTRACT

A method of imparting smolder resistance to cotton batting and other cellulosic materials through the use of the vapors from a mixture of boric acid, methyl alcohol, methyl borate and water at 18° to 68° C (65° to 155° F).

4 Claims, No Drawings

VAPOR PHASE PROCESS TO IMPART SMOLDER RESISTANCE TO COTTON BATTING AND OTHER CELLULOSIC MATERIALS

This invention relates to a system for treating cellulosic textile materials, including those in fibrous forms, with vaporizable chemical reagents that confer smolder resistance. More particularly the invention relates to the production of products that when installed in a mattress possess the property of resistance to ignition by burning cigarettes. More specifically this invention discloses chemical systems and solvents which, by virtue of their inherent properties, form intermediates that exhibit higher vapor pressures than either components(s) individually thus permitting the application of the active smolder resist compound in the form of a vapor to cellulosic products at essentially ambient temperature without the need for subsequent processing involving the use of thermal energy for drying, while concurrently minimizing pollution and the cost of achieving the performance desired.

DEFINITIONS

The word "system" is employed throughout this specification to describe a mixture of chemicals used in the invention described herein.

The word "technique(s)" is employed throughout this specification to describe the methods and apparatus used in the invention described herein.

The words "smolder resistance" are employed throughout this specification to describe the ability of a product to resist ignition from a burning cigarette especially as this characteristic is defined by the Federal Mattress Flammability Standard FF 4-72.

The words "textile materials" as employed throughout this specification are understood to encompass fibers to finished fabrics and all intermediate products.

The main objective of this invention is to provide a technique and a system for the treatment of cellulosic textile materials which is more efficient and less costly than existing procedures and provide smolder resistance especially in the context of the manufacture of mattresses and upholstered furniture. A second objective of this invention is the minimization of the use of energy in processing concurrent with an abatement of pollution that is normally associated with chemical processing of textile materials.

Other objectives and advantages of the invention will become apparent from the following review of the prior art in comparison with that taught by this invention.

PRIOR ART

Much information on chemical systems and techniques to impart resistance to flaming and glowing to cellulosic textile materials is readily available from the technical literature. This wealth of information pertains to and concerns itself primarily with the development of products that meet certain federal and state standards which apply specifically to apparel uses, and to a lesser degree with textile products such as carpets and draperies. The criterion for the "flame retardance" and accompanying glow, sometimes referred to as "afterglow," of such products is directly related to procedures in which the textile material is evaluated by an open flame test while the specimen is held in a vertical, inclined or horizontal position. When cellulosic textile materials that pass the above tests with acceptable char length and afterglow are installed in mattresses the product mattresses fail to pass the Mattress Flammability Standards FF 4-72. This failure occurs because when a cigarette is used as the ignition source a state of smoldering combustion ensues. Smoldering combustion in this context is a direct oxidation from the solid state. Flaming combustion is in reality an oxidation of the gaseous products from the thermal decomposition of a material. When textile materials are tested by such methods as the vertical, inclined or horizontal procedures they can, and do, conduct, convect and radiate heat. In a mattress or upholstered furniture cushion such dissipation of heat is minimal or non-existant, and once a critical temperature is reached, self-sustained smoldering combustion occurs. Such smoldering combustion, a very slow oxidative reaction in comparison with flaming combustion, is self-sustaining in atmospheres containing as little as 1% oxygen so long as the temperature within the combusting structure exceeds 450° C (750° F). Where smoldering combustion is occurring, for example in a mattress, the local temperatures frequently exceed 600° C (1100° F). Textile materials under evaluation by the vertical, inclined or horizontal test procedures rarely if ever exceed a temperature of 400° C. The difference between the temperatures for smoldering combustion in a mattress and that of combustion of textiles evaluated by the vertical, inclined or horizontal tests explains why products classified flame retardant-glow resistant by these test procedures fail in mattress structures which are undergoing smoldering combustion. There are indications that effective flame retardant and glow resist compounds for apparel, carpets and draperies are chemically destroyed at temperatures of about 400° C, consequently they are lost from the treated material at temperatures well below that at which they would be needed to provide resistance to smoldering as it occurs in a mattress. Prior art has shown that boric acid, while not very effective as a flame retardant, can provide sufficient resistance to smoldering combustion of cellulosic materials when they are installed in mattresses to pass the Federal Mattress Standard FF 4-72. A number of techniques have been employed to impregnate or coat cellulosic fibers for cushioning applications with boric acid. Among these are a dry powder technique in which the boric acid is dusted on the fibers after garnetting. The equipment for such a process is low in cost, but the chemical costs are high due to losses of the powder during mechanical handling. The permanence of such treatments are questionable due to possible losses from subsequent flexing of the product in use. The permanence of such treatments are further suspect in that boric acid has a vapor pressure in its solid state, and therefore is easily lost from the treated textile material over a period of time. Another technique involves the spraying of cellulosic fibers with a concentrated solution of boric acid plus other flame retardants. The problems inherent with this technique are non-uniform deposition of the chemical system, especially when it is applied to tufts of fibers in the opener prior to garnetting, the lack of water to achieve good and uniform penetration of the individual fibers, and the need for subsequent drying. This results in much surface deposition of the boric acid which makes subsequent loss at a rapid rate a distinct possibility. A wet padding using boric acid in water overcomes some of the problems described for the two preceeding techniques in so far as uniformity of deposition of the chemical system is concerned. In the wet process it is necessary to use hot water (about 160° F), or to use ammonium carbonate or ammonium bicarbonate to enhance the solubility of the boric acid to the point where sufficient add-on can be obtained at ambient temperature with a wet pick-up of about 100% by weight of the material being treated. While such products pass the Mattress Flammability Standard FF 4-72 consistently, the costs incurred in capital equipment and the costs of thermal energy to achieve drying make the process unattractive. With the water-boric acid system the chemical is deposited within the fibers provided that drying is controlled to avoid excessive loss by vaporization of the boric acid. Such properly treated fibers tend to lose their boric acid at a slower rate than do products in which the boric acid is surface deposited. Boric acid is much more soluble in alcohols such as methanol and ethanol than it is in water, and it has been shown that products which comply with the Mattress Flammability Standard can be produced by impregnating cellulosic fibers with such systems. Treated materials from these techniques pass FF 4-72 provided that extreme care is used in drying. The need for drying control stems from the ease of removal of boric acid as a methyl or ethyl ester when elevated temperatures are used, and migration of boric acid to the fiber surface under certain conditions. Such surface deposition as described previously is not conducive to prolonged service life.

DESCRIPTION OF INVENTION

Almost all of the inherent disadvantages of the above described techniques and systems are overcome by the instant invention which utilizes the vapors obtained from a system which consists of methanol, boric acid, methyl borate and water having a boiling point of about 68° C. The cellulosic material to be treated is not contacted by any of the reagents in liquid form but only by the vapors. As a consequence no drying is required, the reaction proceeds at ambient temperature, migration tendencies are practically eliminated, good uniform deposition of boric acid within the fibers is achieved in a very short time interval usually less than 5 minutes. Chemical efficiency is improved and pollution is abated.

The impregnation with vapors can be conducted in an enclosed vapor-tight chamber or reactor on a batchwise basis or alternatively on a continuous basis using conveyers in an appropriate enclosed room employing the speed of the conveyor to control exposure time.

The technique of treatment in the instant invention involves charging a suitable container usually, although not necessarily, located at the bottom of the chamber or reaction vessel with a solution of boric acid in anhydrous methyl alcohol. The concentration of boric acid in the alcohol can be varied from 5 to 27.2% by weight, the latter being the saturation value at about 20° C (68° F). After an interval of time to allow the vapors from the alcohol-boric acid-methyl borate to saturate the space above the source, the cellulosic material to be treated is positioned in the vapors so that it does not contact the solution. Exposure times can be varied from 1 minute up to 2 hours. The temperature in the chamber or reactor can be varied from ambient to 71° C (160° F). Temperature affects the amount of boric acid deposited upon the cellulosic textile material being treated however adequate treatments at ambient temperature (65° F) are possible. The amount of water present in the cellulosic material being treated does affect the add-on of boric acid achieved because the water present will react with methyl esters such as methyl borate to hydrolize them back to boric acid. Table 1 shows the relationship of moisture in the cotton batting sample to the actual amount of boric acid deposited on and within the fibers. Of importance is that at least 7% moisture content is necessary when the sample is subjected to the above conditions to pass FF 4-72 the Mattress Flammability Standard.

Table 1

RELATIONSHIP OF BORIC OXIDE AND MOISTURE CONTENT IN COTTON BATTING*

| % Moisture Content of Batts | $B_2O_3$ % | $H_3BO_3$ % | FF 4-72 Requirements |
|---|---|---|---|
| 5.30 | 0.49 | 0.86 | Fail |
| 7.23 | 1.56 | 2.76 | Fail |
| 7.72 | 1.78 | 3.15 | Pass |
| 8.78 | 2.15 | 3.81 | Pass |
| 11.26 | 3.97 | 7.03 | Pass |

*Treatment of 5 min. exposure to vapors
Temperature = 65° F

The preferred conditions for the vapor phase treatment of cellulosic textile materials with boric acid are as follows: a chemical system consisting of 27.2% boric acid by weight and 72.8% anhydrous methyl alcohol by weight, a temperature within the chamber or reactor of 18° to 27° C (65° to 80° F), a moisture content in the cellulosic material being treated of about 10% by weight, and an exposure time of about 5 minutes. Products prepared in the preferred manner contain about 3.15 to 6.31% boric acid as calculated from chemical analysis for boric oxide. When the textile material of choice is either garnetted cotton batting or cotton batting rawstock an add-on of boric acid of 4.8% is adequate to prevent cigarette ignition and smoldering when they serve as the filling material in mattresses.

The following list of examples is presented to illustrate this invention. The examples are not intended to limit the scope of the invention in any manner.

EXAMPLE 1

A mixture of first cut cotton linters (60% by weight), and textile waste fibers (40% by weight) which had been opened, cleaned, formed into picker laps and subsequently garnetted into batts having a nominal density of 2 lbs/ft$^3$ were used as the cellulosic feed material. Samples of this batting approximately 3 × 3 × 2 in. were placed in a reaction vessel whose volume was 1.83 ft$^3$. The samples were located approximately 14 in. above a solution containing 27.2% by weight of boric acid and 72.8% by weight of methanol. The solution had been allowed to come to equilibrium with its vapors at ambient temperature (65° F) in accordance with the chemical formula $$\underset{CH_3OH}{H_3BO_3} + 4\ CH_3OH \rightleftharpoons B(OCH_3)_3 + 3\ H_2O +$$

so that a condition existed wherein the vapor phase contained methyl borate, methyl alcohol and a small amount of water. The moisture content of the cotton when it was placed in the reaction vessel was 9.44%.

Moisture hydrolizes the methyl borate at a rate that, according the literature, is too fast to measure. Thus any methyl borate in the vapors that contact to cotton are immediately converted to boric acid as indicated in the left hand portion of the formula given above. Samples of cotton batting in contact with the vapor phase of the above described mixture were analyzed for boric oxide content by a volumetric titration employing mannitol and sodium hydroxide. Table 2 shows the boric oxide and corresponding boric acid content of the products after exposure for the times indicated:

Table 2

EFFECT OF EXPOSURE TIME ON BORIC ACID ADD-ON AT 65° F (18° C)

| Time in Minutes | Boric Oxide Content % by weight | Boric Acid Content % by weight |
|---|---|---|
| 1 | 1.05 | 1.86 |
| 5 | 1.98 | 3.51 |
| 15 | 2.00 | 3.55 |
| 30 | 2.01 | 3.56 |
| 60 | 2.32 | 4.11 |
| 240 | 2.99 | 5.30 |
| 420 | 3.47 | 6.15 |

Experimental data in Table 1 show that where the boric oxide content applied by vapor phase techniques exceeds 1.78% the products will pass the Mattress Flammability Standard. Thus a 5 minute exposure would be adequate for the intended end use.

EXAMPLE 2

Cotton batts made as described in example 1 and having the same initial moisture content were treated according to the process of Example 1 except that the temperature was 155° to 160° F (68° to 71° C), the boiling range of the solution described in Example 1. Samples of the batting undergoing impregnation were removed from the vapors at the time intervals shown in Table 3, and analyzed for boric oxide content.

Table 3

EFFECT OF EXPOSURE TIME ON BORIC ACID ADD-ON AT 155° TO 160° F (68° TO 70° C)

| Time in Minutes | Boric Oxide Content % by weight | Boric Acid Content % by weight |
|---|---|---|
| 1 | 1.98 | 3.51 |
| 5 | 2.93 | 5.20 |
| 15 | 2.81 | 4.98 |
| 30 | 2.80 | 4.96 |
| 60 | 2.94 | 5.21 |
| 75 | 2.87 | 5.09 |
| 105 | 2.90 | 5.14 |

Samples exposed for only 1 minute contained sufficient boric acid to pass FF 4-72 when installed in mattresses.

EXAMPLE 3

Cotton batts were made as described in Example 1 and treated in accordance with the process of Example 2 except that the initial moisture content of the cotton batting had been adjusted to 12.96% by weight. A sample of the batting was removed after 3 minutes exposure to the vapors at 155°–160° F, and a second sample removed after 5 minutes exposure. Analysis of the 3 minute sample disclosed that it had an add-on of 4.19% by weight of boric oxide equivalent to 7.43% boric acid. The 5 minute sample contained 5.02% boric oxide equivalent to 8.90% boric acid. When installed in a mattress structure these products pass FF 4-72.

EXAMPLE 4

Cotton batts made as described in Example 1 and treated in accordance with the process of Example 1 except that the concentration of boric acid in the methanol liquid phase was controlled to 5% by weight in one instance, and to 10% by weight in another. The initial moisture content of the cotton batting was 7.59%. After 30 minutes exposure to the vapors from the 5% boric acid-methyl alcohol solution a sample of the batting contained 1.56% boric oxide (2.76% boric acid) by analysis. After 30 minutes exposure to the vapors of the 10% boric acid-methyl alcohol solution a sample of batting contained 1.42% boric oxide (2.51% boric acid) by analysis. These products did not contain sufficient boric acid to pass FF 4-72 when installed in a mattress structure.

EXAMPLE 5

A sample of rayon picker lap was treated in accordance with the process of Example 2. The initial moisture content of the rayon was 14%. After exposure for 5 minutes a sample of the rayon when analysed showed a boric oxide content of 4.08% equivalent to 7.23% boric acid by weight. After 30 minutes exposure a sample of the rayon showed a 4.88% boric oxide content upon analysis, equivalent to 8.65% boric acid by weight.

EXAMPLE 6

Cotton batts made as described in Example 1 were treated according to the process of Example 1 except that 7% concentrated sulfuric acid was added to the 27.2% boric acid-methanol solution to sequester the water produced by the chemical reaction described in the formula shown in Example 1. The initial moisture content of the cotton batting for this example was 8.42%, and the reaction temperature maintained at 65° F (18° C). Table 4 shows the boric oxide content and the boric acid content of samples which were removed after exposure to the vapors for varying periods of time.

Table 4

EFFECT OF MOISTURE IN VAPORS UPON BORIC ACID ADD-ON AT 65° F (18° C)

| Exposure Time in Minutes | Boric Oxide Content % by weight | Boric Acid Content % by weight |
|---|---|---|
| 1 | 0.99 | 1.76 |
| 3 | 2.46 | 4.36 |
| 5 | 2.61 | 4.63 |
| 15 | 3.44 | 6.10 |
| 30 | 3.43 | 6.09 |
| 60 | 3.91 | 6.93 |
| 120 | 3.71 | 6.58 |

All samples having exposure times of 3 minutes or more pass the Mattress Flammability Standard FF 4-72.

EXAMPLE 7

Cotton batts as described in Example 1 were dried in a laboratory oven to a moisture content of 0.1%, and then exposed to the vapors from a methyl alcohol and boric acid mixture at 155° F as described in Example 2. Table 5 shows the boric oxide content and the boric acid content of these batts after different exposure times.

Table 5

BORIC ACID ADD-ON AT 0.1% MOISTURE CONTENT OF COTTON AT 155° F (68° C)

| Time in Minutes | Boric Oxide Content % by weight | Boric Acid Content % by weight |
|---|---|---|
| 1. | 0.341 | 0.605 |
| 3 | 0.378 | 0.670 |
| 5 | 0.436 | 0.773 |
| 15 | 0.407 | 0.722 |

None of these products would pass the Mattress Flammability Standard FF 4-72 when installed in mattresses.

EXAMPLE 8

A sample of cotton fabric, 8 oz/yd$^2$, whose moisture content was 5.05%, and a sample of glass fabric whose moisture content was 0.01% were exposed to the vapors as described in Example 6. After 30 minutes exposure the cotton fabric analysed 1.15% boric oxide (2.03% boric acid) and the glass fabric 0.07% boric oxide (0.12% boric acid).

EXAMPLE 9

Cotton batts made as described in Example 1 were treated in accordance with the process of Example 1 except that the source of methyl borate was a system consisting by weight 23.79% borax ($Na_2B_4O_7.10\ H_2O$), 63.97% anhydrous methyl alcohol, and 12.24% sulfuric acid (analytical grade 37 N.). The initial moisture content of the cotton batting was 7.34% and the temperature of the reaction was maintained at 70° F (21° C). Table 6 shows the boric oxide content and the boric acid content of samples which were removed after exposure to the vapors for varying periods of time.

Table 6

EFFECT OF EXPOSURE TIME UPON BORIC OXIDE AND BORIC ACID CONTENT OF COTTON BATTING EXPOSED TO VAPORS FROM A BORAX-METHANOL-SULFURIC ACID SYSTEM AT 70° F

| Exposure Time in Minutes | Boric Oxide Content % by weight | Boric Acid Content % by weight |
|---|---|---|
| 1 | 0.68 | 1.21 |
| 5 | 1.34 | 2.38 |
| 15 | 1.54 | 2.73 |
| 30 | 2.35 | 4.17 |
| 60 | 2.84 | 5.00 |
| 140 | 3.75 | 6.65 |

Exposure time of 30 minutes provided samples that exceed the boric oxide content needed to pass FF 4-72 as shown in Table 1. Similar add-ons could be expected if boric oxide and anhydrous methanol were used as the chemical system to produce the methyl borate vapors.

We claim:

1. A process for imparting smolder resistance to a cellulosic material which process comprises contacting a cellulosic material having a water content of at least 0.1 percent with vapors of a system which consists of methanol, boric acid, methyl borate, and water having a boiling point of about 68° C and which reacts with the water present in the cellulosic substrate to form boric acid, maintaining the cellulosic material and vapors in contact between 1 and 120 minutes and temperatures at which the contact is conducted being maintained between 18° and 71° C so that the cellulosic material is rendered smolder resistant.

2. The process of claim 1 wherein the cellulosic material is cotton batting.

3. The process of claim 1 wherein the concentration of boric acid in the alcohol is between 5 and 27.2 weight percent.

4. A process for imparting smolder resistance to a cellulosic material which process comprises contacting a cellulosic material having a water content of approximately 7 percent with vapors of a system which consists of a solution of 23.79% by weight sodium borate of the formula $Na_2B_4O_7.10\ H_2O$ in 63.9% by weight anhydrous methanol and 12.24% by weight concentrated sulfuric acid, maintaining the cellulosic material and vapors in contact between 1 and 120 minutes and at a temperature at which the contact is conducted at approximately 21° C.

* * * * *